United States Patent [19]

Casey, Jr.

[11] Patent Number: 4,670,987

[45] Date of Patent: Jun. 9, 1987

[54] CUTTING TOOL FOR OPENING ROD CANS

[76] Inventor: Gordon C. Casey, Jr., 3011 S. 90th East Ave., Tulsa, Okla. 74129

[21] Appl. No.: 330,163

[22] Filed: Dec. 14, 1981

[51] Int. Cl.[4] ..... B25G 1/00

[52] U.S. Cl. ..... 30/443; 30/315

[58] Field of Search ..... 30/443, 315, 156, 296 A, 30/400, 445, 314

[56] References Cited

U.S. PATENT DOCUMENTS

| | | | |
|---|---|---|---|
| 384,973 | 6/1888 | Hawes | 30/443 X |
| 717,254 | 12/1902 | Nettles | 30/443 |
| 1,095,251 | 5/1914 | Washburne | 30/314 X |
| 1,850,090 | 3/1932 | Alexander | 30/156 |
| 2,011,062 | 8/1935 | Masamitsu | 30/314 X |
| 2,333,241 | 11/1943 | Foster | 30/315 |
| 2,573,381 | 10/1951 | Arnold | 30/289 X |
| 3,474,535 | 10/1969 | Kramer | 30/315 |
| 3,865,370 | 2/1975 | Rogers | 30/169 X |
| 4,205,440 | 6/1980 | Morgan | 30/287 |

FOREIGN PATENT DOCUMENTS

| | | | |
|---|---|---|---|
| 139272 | 3/1920 | United Kingdom | 30/443 |

*Primary Examiner*—Frederick R. Schmidt
*Assistant Examiner*—Debra S. Meislin
*Attorney, Agent, or Firm*—William S. Dorman

[57] ABSTRACT

A tool for opening the ends of cans or metal containers which are used to store and ship welding rods or electrodes, the can having four elongated rectangular sides closed over by two opposite ends which are attached to the sides by beads; the tool being made from a relatively thin sheet of metal and having a forward flat triangular shaped portion terminating in a forward point, a pair of spaced legs extending rearwardly away from the triangular shaped portion and away from the point, a handle connected to the outer ends of the legs, a portion of the trianglular shaped section between the point and the handle being bent upwardly at right angles to form a protective shield for the operator of the tool, whereby the tool can be applied to the can adjacent one of the ends so that the point is just behind the bead, the triangular portion of the tool being wider than one of the sides of the can such that it can be pushed entirely into the side so as to cut the corners of the can adjacent the side being cut.

1 Claim, 9 Drawing Figures

CUTTING TOOL FOR OPENING ROD CANS

BACKGROUND OF THE INVENTION

1. Field of the Invention

The present invention relates to a cutting tool and more particularly to a cutting tool which can be used to open the ends of cans which are used to ship and store welding rods or electrodes.

2. Prior Art

Welding rods or electrodes are sometimes provided in cans or metal containers which are used to store and ship the welding rods. The welding rods or electrodes generally contain a fluxing material which must be kept out of contact with rain and other moisture. Accordingly, the containers in which the rods are shipped are a little more rugged and a little thicker than the conventional tin can that one would find on a grocer's shelf. Therefore, these cans or metal containers which contain the welding rods are invariably very difficult to open. Welders sometimes use grinding tools to open the ends of these cans, with occasional consequent injury.

As a result of a preliminary search conducted on the present invention, the following prior art references were uncovered:

U.S. Pat. Nos.: 717,254; 2,333,241; 1,095,251; 2,573,381; 2,011,062; 3,865,370; 4,205,440.

Foster U.S. Pat. No. 2,333,241, shows a knife used for an entirely different purpose from that of the present invention. The knife of Foster has a blade portion 10, a handle portion 13 with finger openings 14 and a guard 20.

Morgan U.S. Pat. No. 4,205,440, shows a package opening device having a blade portion 16 and guards 24. The remaining patents do not appear to require comment.

SUMMARY OF THE INVENTION

The present invention relates to a tool for opening the ends of cans or metal containers which are used to store and ship welding rods or electrodes. The welding rods or electrodes generally contain a fluxing material which must be kept out of contact with rain and other moisture. Accordingly, the containers in which the rods are shipped are a little more rugged and a little thicker than the conventional tin can that one would find on a grocer's shelf. These cans are constructured from four elongated rectangular sides closed over by two opposite ends which are attached to the sides by beads. Therefore, these cans or metal containers which contain the welding rods are invariably very difficult to open. Welders sometimes use grinding tools to open the ends of these cans, with occasional consequent injury.

The tool of the present invention which is used for opening the ends of cans or metal containers of the type described above is made from a relatively thin sheet of metal having a forward flat triangular or trowel shaped portion terminating in a forward point. To the rear of the trowel shaped portion, the flat surface extends into a pair of legs which are welded to a tube, the latter serving as a handle. The portion of the trowel shaped section between the point and the handle is bent upwardly at right angles to form a protective shield for the operator, as will hereinafter appear.

The manner in which the tool is employed can now be described. The can or container for the rods is essentially rectangular in shape, having square ends. Each square end is provided with a bead which connects it with the main body of the can. The tool is applied so that the point is just under or behind the bead. The guard will prevent the hands from being cut when the tool is pushed into the can. The trowel portion of the tool is wider than one of the sides of the can such that it can be pushed entirely into the side so as to cut both adjacent corners.

Starting from an initial position with the point just behind the bead, the operator pushes down with his hands until the point pierces the side of the can; he continues pushing on the tool until the entire top surface is cut including the corners of the can. The operator withdraws the tool and turns the can 90° counterclockwise. The tool is again inserted behind the bead, but now on the surface which was to one side in the first step, and the operation is repeated until this surface and another corner is cut through. The operator again withdraws the tool and turns the can an additional 90° counterclockwise. The tool is again inserted behind the bead, but now on the surface which was at the bottom in the first step, and the operation is repeated until this surface and the fourth corner is cut through. In each of the above described operations, the shield or guard prevents the hands of the operator from coming in contact with the cut portions of the can.

Since the only attachment of the end to the can now is the short strip from the side which was not cut by the tool, the end can be bent away from the can as a flap to permit easy withdrawal of the welding rods, as desired. The resulting flap is preferably left attached to the can because it generally lists information regarding the physical and/or electrical properties of the rods contained in the can.

It is, of course, necessary that the point be sufficiently sharp to penetrate the sides of the can; however, the edges of the trowel portion need not necessarily be sharpened, but they may be, if desired. The tool is preferably made from a relatively thin sheet of metal, but of sufficient thickness that it will not bend appreciably during the cutting operations described above.

DESCRIPTION OF THE PREFERRED EMBODIMENTS

Figure 1:
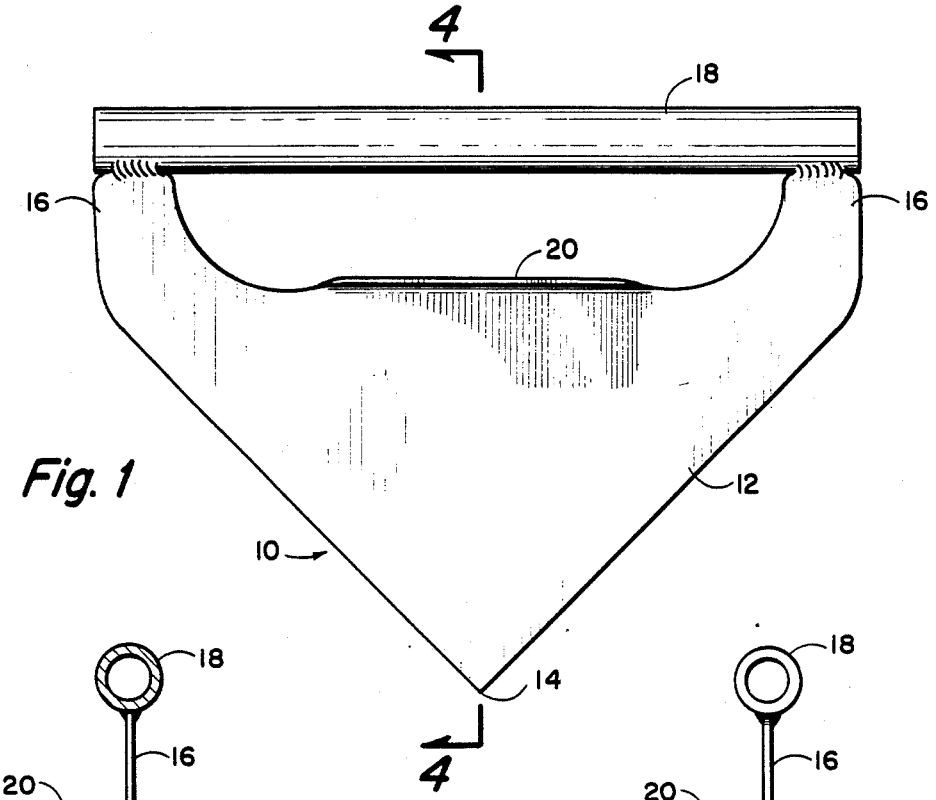
FIG. 1 is a plan view of the cutting tool of the present invention.
Figure 4:
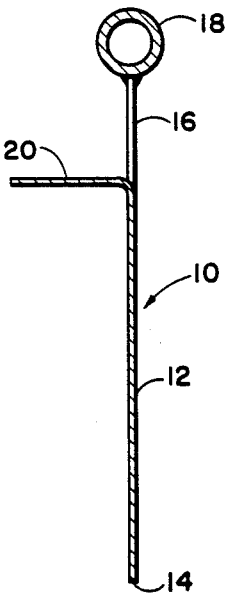
FIG. 4 is a sectional view taken along section line 4—4 in FIG. 1.
Figure 3:
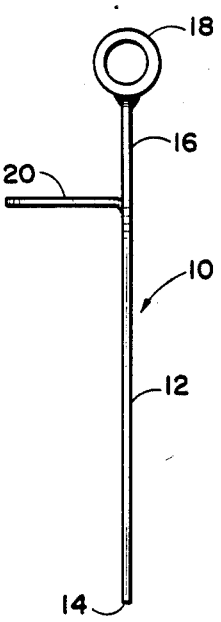
FIG. 3 is a side elevational view of the cutting tool shown in FIG. 1.
Figure 2:
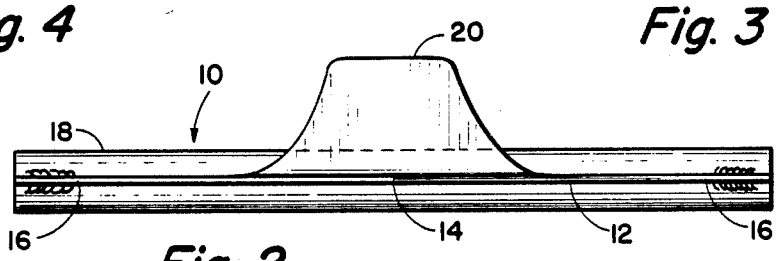
FIG. 2 is a front view of the cutting tool shown in FIG. 1.

The present invention relates to a tool for opening the ends of cans or metal containers which are used to store and ship welding rods or electrodes. The welding rods or electrodes generally contain a fluxing material which must be kept out of contact with rain and other moisture. Accordingly, the containers in which the rods are shipped are a little more rugged and a little thicker than the conventional tin can that one would find on a grocer's shelf. Therefore, these cans or metal containers which contain the welding rods are invariably very difficult to open. Welders sometimes use grinding tools to open the ends of these cans, with occasional consequent injury.

Referring to the drawings in detail, FIGS. 1 to 4 show a cutting tool 10 which has a forward triangular or trowel shaped portion 12 terminating in a forward point 14. To the rear of the trowel shaped portion 12, the flat surface extends into a pair of legs 16 which are welded to a tube 18, the latter serving as a handle. The portion of the trowel shaped section between the point 14 and the handle 18 is bent upwardly at right angles to form a protective shield 20 for the operator, as will hereinafter appear.

Figure 5:
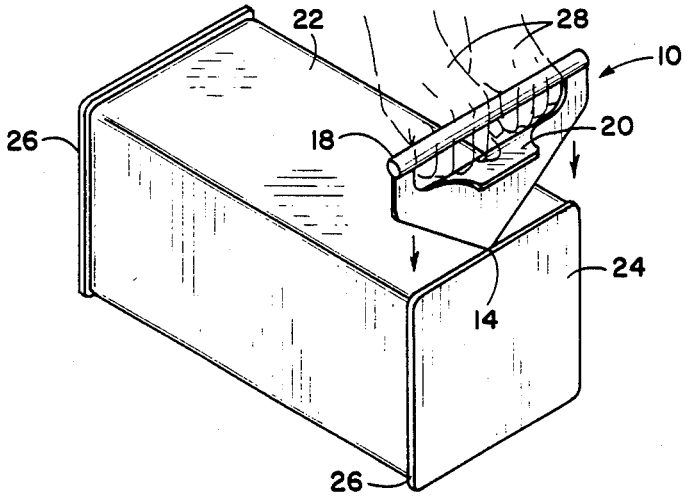
FIG. 5 is a perspective view showing the application of the cutting tool of the present invention to a can containing welding rods.
Figure 6:
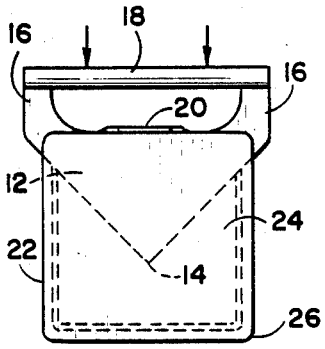
FIG. 6 is an end view taken from FIG. 5 showing the cutting of a first side of the can with the tool of the present invention.
Figure 7:
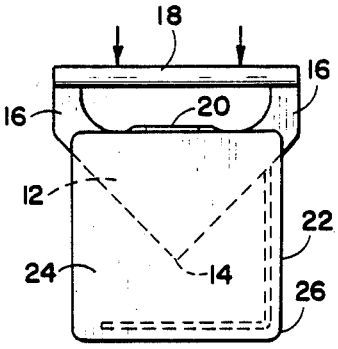
FIG. 7 is another end view taken from FIG. 5 showing the cutting of a second side of the can with the tool of the present invention.
Figure 8:
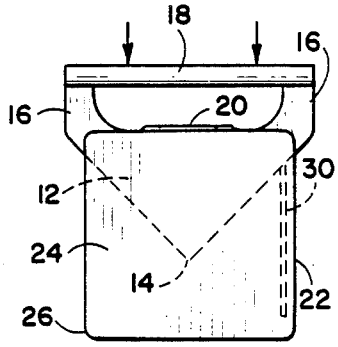
FIG. 8 is still another end view taken from FIG. 5 showing the cutting of a third side of the can with the tool of the present invention.

Referring now to FIGS. 5 to 8, these figures show the manner in which the tool 10 is employed. The can or container 22 for the rods is essentially rectangular in shape, having square ends 24, only one of which is clearly shown. The square end 24 is provided with a bead 26 which connects with the main body of the can 22. The tool 10 is applied so that the point 14 is just under or behind the bead 26. FIG. 5 shows a pair of hands 28 applied to the handle 18. As also shown in this figure, the fingers of the hands 28 are received in the space between the handle 18, the guard 20, and the side legs 16. The guard 20 will prevent the hands from being cut when the tool is pushed into the can. It should be noted that the trowel portion 12 of the tool 10 is wider than one of the sides of the can 22 such that it can be pushed entirely into the side so as to cut both upper corners as shown in FIG. 6.

Starting from the position shown in FIG. 5 with the point 14 just behind the bead 26, the operator pushes down with his hands 28 until the point 14 pierces the side of the can 22; he continues pushing on the tool until the entire top surface is cut including the corners of the can as shown in FIG. 6. The operator withdraws the tool and turns the can 90° counterclockwise with respect to FIG. 6, for example to the position shown in FIG. 7. The tool is again inserted behind the bead 26, but now on the surface which was to the rear on FIG. 5, and the operation is repeated until this surface and another corner (to the right in FIG. 7) is cut through. The operator again withdraws the tool and turns the can an additional 90° counterclockwise to reach the condition shown in FIG. 8. The tool is again inserted behind the bead 26, but now on the surface which was at the bottom in FIG. 5, and the operation is repeated until this surface and the fourth corner (to the right in FIG. 8) is cut through. In each of the above described operations, the shield or guard 20 prevents the hands 28 of the operator from coming in contact with the cut portions of the can.

Figure 9:
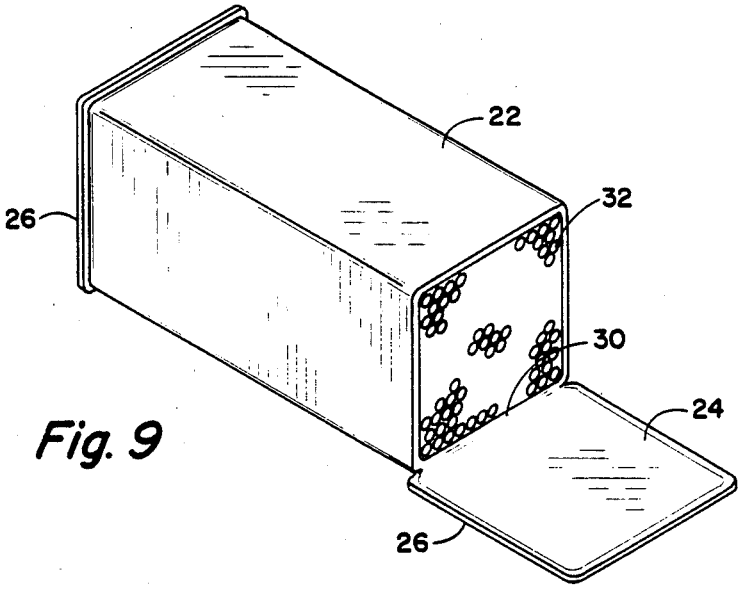
FIG. 9 is a perspective view of the can cut by the three operations shown in FIGS. 6 to 8, and further showing the cut end bent downwardly away from the can.

Since the only attachment of the end 24 to the can 22 now is the short strip 30 from the uncut side which was in the foreground in FIG. 5, the end 24 can be bent away from the can 22 as a flap, as shown in FIG. 9, to permit easy withdrawal of the welding rods 32, as desired. The resulting flap 24 is preferably left attached to the can because it (the end 24) generally lists information regarding the physical and/or electrical properties of the rods 32 contained in the can 22.

It is, of course, necessary that the point 14 be sufficiently sharp to penetrate the sides of the can; however, the edges of the trowel portion need not necessarily be sharpened, but they may be, if desired. The tool 10 is preferably made from a relatively thin sheet of metal, but of sufficient thickness that it will not bend appreciably during the cutting operations described above.

Whereas the present invention has been described in particular relation to the drawings attached hereto, it should be understood that other and further modifications, apart from those shown or suggested herein, may be made within the spirit and scope of this invention.

What is claimed is:

1. A tool for opening the ends of cans or metal containers which are used to store and ship welding rods or electrodes, said can having four elongated rectangular sides closed over by two opposite ends which are attached to the sides by beads; said tool being made from a relatively thin sheet of metal and having a forward flat triangular shaped portion terminating in a forward point, a pair of spaced legs each leg having an inner end and an outer end, the spaced legs being connected at their inner ends to the triangular shaped portion so as to extend rearwardly away from the triangular shaped portion and away from said point, a handle connected to the outer ends of said legs, a part of the triangular shaped portion between the point and the handle being bent upwardly at right angles to form a protective shield for the operator of the tool, whereby the operator of the tool can insert his fingers in the resulting space formed by the handle, the shield and the spaced legs, and, whereby the tool can be applied to the can adjacent one of the ends so that the point is just behind the bead, the triangular portion of the tool being wider than one of the sides of the can such that it can be pushed entirely into the side so as to cut the corners of the can adjacent the side being cut.

* * * * *